US009429002B2

(12) United States Patent
Knapp

(10) Patent No.: US 9,429,002 B2
(45) Date of Patent: Aug. 30, 2016

(54) SYSTEMS AND METHODS FOR ADJUSTING OPERATION OF AN ESP MOTOR INSTALLED IN A WELL

(71) Applicant: Baker Hughes Incorporated, Houston, TX (US)

(72) Inventor: John M. Knapp, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/608,046

(22) Filed: Jan. 28, 2015

(65) Prior Publication Data

US 2016/0215601 A1 Jul. 28, 2016

(51) Int. Cl.
*E21B 43/12* (2006.01)

(52) U.S. Cl.
CPC ..... *E21B 43/128* (2013.01)

(58) Field of Classification Search
CPC .. E21B 43/128; E21B 43/121; E21B 43/126; F04B 2203/0201; F04B 2203/0202; F04B 2203/0204; F04B 2203/0401; F04B 2203/0402; F04B 2203/0404; F04B 2201/1202; F04B 49/20; F04B 49/06; F04B 47/02; H02P 9/44
See application file for complete search history.

(56) References Cited

U.S. PATENT DOCUMENTS

| | | | | |
|---|---|---|---|---|
| 7,191,067 | B1 * | 3/2007 | Berry | E21B 43/128 702/9 |
| 8,672,641 | B2 * | 3/2014 | Yuratich | E21B 43/128 417/44.1 |
| 8,937,448 | B2 * | 1/2015 | Allen | E21B 43/128 318/438 |
| 2005/0281681 | A1 * | 12/2005 | Anderson | E21B 41/0021 417/44.11 |
| 2009/0119036 | A1 * | 5/2009 | Jayanth | F04B 49/065 702/60 |
| 2013/0175030 | A1 * | 7/2013 | Ige | E21B 43/128 166/250.15 |

* cited by examiner

*Primary Examiner* — James G Sayre
(74) *Attorney, Agent, or Firm* — Law Offices of Mark L. Berrier

(57) ABSTRACT

Systems and methods for controlling an ESP installed in a well. The ESP is operated at a first voltage, and the current actually drawn by the ESP motor is monitored and compared to an expected current. If the actual current differs from the expected current, the actual horsepower load on the ESP motor is determined by multiplying an expected horsepower load by the ratio of the actual current to the expected current. A load saturation curve for the actual horsepower load is determined, and a voltage is identified on this curve at which the corresponding current is minimized. The ESP motor is then operated at this new voltage to optimize the efficiency of the motor.

18 Claims, 4 Drawing Sheets

SYSTEMS AND METHODS FOR ADJUSTING OPERATION OF AN ESP MOTOR INSTALLED IN A WELL

BACKGROUND

1. Field of the Invention

The invention relates generally to control systems, and more particularly to systems and methods for controlling an electric submersible pump (ESP) used in downhole oil production, wherein the voltage of the power supplied to the ESP is optimized for the load that is actually experienced by the ESP.

2. Related Art

Oil is normally produced through wells that are drilled into oil-bearing geological formations. In many instances, the pressure in the formation is insufficient to force the oil to the surface of the well, so artificial lift systems such as ESP's are used to pump the oil out of the wells. Typically, the ESP motor for a particular well is selected so that the shaft power produced by the motor (when operated at the "nameplate" rating) matches the shaft load that is expected to be generated by the ESP pump as it lifts the oil out of the well. (The "nameplate" rating consists of a set of values for operating parameters—typically frequency, voltage, current, horsepower—that are assigned to a motor when it is manufactured and are identified on a nameplate for the motor.)

In many instances, however, the actual shaft load of the pump when it is installed in the well is not the expected load. If the mismatch is relatively small, it may not be significant. If, on the other hand, the mismatch is large, the efficiency of the motor may be significantly reduced. If it is determined before installation of the ESP that the shaft load of the pump will be different than expected, the motor can be re-rated from the nameplate rating so that the efficiency of the motor is optimized. It is more challenging to deal with the situation in which the motor has been installed and started before it is determined that the pump's load is not as expected. Because the shaft load is unknown, the motor cannot be rerated in the conventional manner. Further, it is difficult, expensive and time consuming to retrieve the ESP from the well and replace the motor with a more suitable design.

It would therefore be desirable to provide improved systems and methods for addressing mismatches between the nameplate rating of an ESP motor and the actual shaft load experienced by the ESP pump.

SUMMARY OF THE INVENTION

This disclosure is directed to systems and methods for controlling an ESP that is installed downhole in a well. The current actually drawn by the ESP is monitored and compared to an expected current. If the actual current is significantly different from the expected current, the actual current is used to determine the actual shaft load on the ESP motor, which is then used to determine a voltage at which the motor should be operated to optimize the efficiency of the motor. The power supplied to the motor is then adjusted to this optimized voltage.

One embodiment of the invention comprises a method for adjusting the operation of an ESP motor when the ESP is installed in a well. The method begins with operation of the motor at a first frequency and a first voltage, where the first voltage is an optimum voltage for an expected shaft load of the motor. The first frequency and first voltage may, for example, be the nameplate frequency and voltage of the motor, and the expected shaft load may be the nameplate horsepower of the motor. The current that is drawn by the motor at the first voltage (the first current) is then determined. This current is compared to an expected current (e.g., the nameplate current) and a difference between the first current and the expected current is determined. In one embodiment, if the difference between the first current and the expected current is below a threshold, the shaft load of the motor is within a desired range of the expected load, so no change is made to the voltage at which the motor is operating. If, on the other hand, the difference between the first current and the expected current meets the threshold, there is a great enough difference between the actual shaft load and the expected shaft load of the motor that the motor is likely operating below a desired efficiency. The determination of the actual shaft load is therefore based on the first current, the expected current and the expected shaft load. In one embodiment, the actual shaft load is determined by computing a ratio of the first current to the expected current, and multiplying the expected shaft load by this ratio. Then, a second voltage is determined based on the actual shaft load, where the second voltage is an optimum voltage (a voltage at which the current drawn by the motor is minimized) for the actual shaft load. The motor is then operated at the second voltage.

In one embodiment, the second voltage is determined by first identifying a load saturation curve associated with the expected shaft load and expected current. This load saturation curve may be scaled from a normalized load saturation curve. After the first load saturation curve is identified, a second load saturation curve that is associated with the actual shaft load of the motor is identified. This second load saturation curve has an optimum voltage at which the current for the motor is minimized. This optimum voltage for the second load saturation curve is selected as the second voltage. In another embodiment, rather than determining the second voltage from the graphical information of the load saturation curves, the second voltage can be determined by determining a ratio of the actual shaft load to the expected shaft load, taking the fourth root of the ratio and multiplying the result by the first voltage to produce the second voltage.

The method, which is implemented to efficiently operate the ESP may include installation of the ESP in the well prior to operating it. The ESP is operated by coupling an electric drive at the surface of the well to the ESP and using the drive to produce an output waveform that is supplied to the ESP motor. The waveform is output at the first voltage and then changed to the second voltage as determined by the method (e.g., as described above). In one embodiment, the determination of the second voltage is dependent upon the difference between the actual current and the expected current. If the difference does not meet a predetermined threshold, the motor is operating with the desired efficiency, so it is not necessary to determine the second voltage or to change the voltage of the output waveform generated by the electric drive. If the difference meets this threshold, the motor is presumed to be operating below a desired efficiency, and the second, optimum voltage is determined as described herein. In some cases, when the second voltage is determined, it may not quite be optimized, so it may be desirable to repeat the process to find a third voltage which is optimized with respect to the second voltage.

Alternative embodiments may include systems, such as electric drive systems, controllers for electric drives, or overall ESP systems that incorporate these drives or controllers. Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
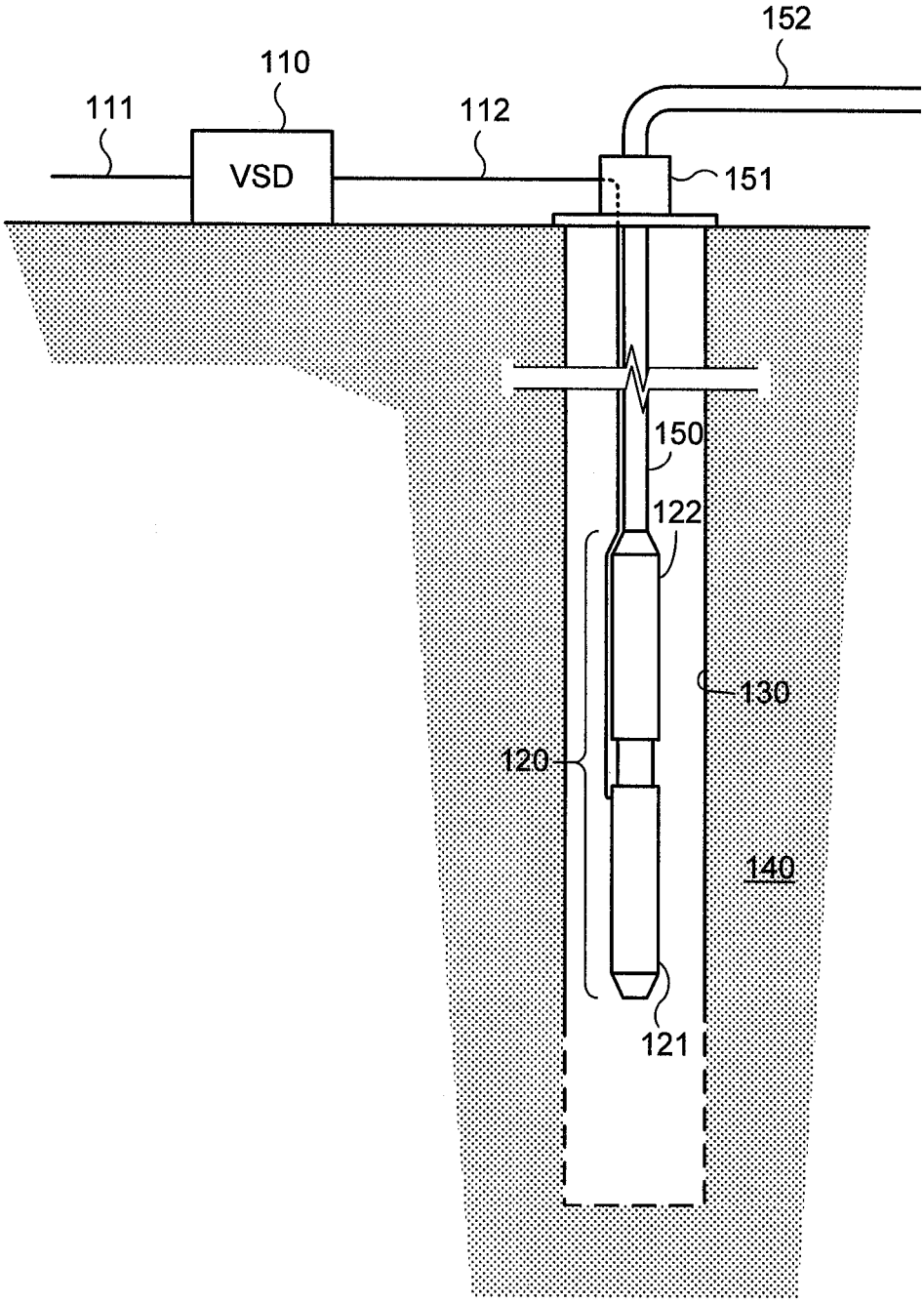
(Prior art) Fig. 1
FIG. 1 is a diagram illustrating a pump system in which the present invention can be implemented.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for controlling an ESP installed in a well, where the voltage of the power supplied to the ESP is optimized for the load that is actually experienced by the ESP.

In a typical ESP application, a pump and motor set are selected so that the shaft load generated by the pump is well-matched to the produced shaft power (horsepower) of the motor when the motor is operated at its nameplate values of voltage and current at a specified frequency. When the shaft load of the pump is matched to the intended shaft power of the motor, the motor operates with optimal efficiency. As noted above, however, in many ESP applications the shaft load of the pump is not as expected once the ESP is installed in the well. In this case, the pump will then be mismatched to the motor. If the mismatch is relatively small (e.g., a few percent), the efficiency of the motor may be high enough that it may not be necessary to change the operating voltage. If the mismatch is large, it may be desirable to "tune" the motor to the actual pump shaft load so that it operates more efficiently. This is possible by adjusting the voltage supplied to the motor. This is known as "rerating" or "application dependent rating" of the motor.

Conventionally, rerating the motor begins before any equipment is installed in the well, when it is determined that the selected motor is expected to power a pump load of a horsepower different from the nameplate rating of the motor. This determination is typically made based on data that was gathered during the operation of previously-installed equipment. As long as the expected shaft load is known, the optimum operating voltage and current for the motor to produce this amount of shaft power can be determined, as will be explained in more detail below. The optimal values will vary with the shaft load.

The rerating of an ESP motor is normally accomplished using data that was obtained prior to operation of the ESP in the well. Once the ESP has been installed in the well, the ESP motor is conventionally operated at either the nameplate voltage (and frequency), or the rerated voltage (and the nameplate frequency). If, however, it is only after the ESP system has been installed and started that the ESP's operation indicates the actual shaft power is different than the expected shaft power, then the problem becomes more difficult, both technically and from a customer relations standpoint.

If the pump/motor mismatch has been detected after the ESP system has been installed, it is expensive and time consuming to pull the system and replace the motor and/or pump with more suitable choices. If this approach is advisable, the desired replacement motor may not be readily available. Even if the desired replacement is available, the occurrence of the mismatch and the need for the replacement will likely cause the customer to question the operator's competence. If the mismatched system is not addressed and the ESP is left to operate as-is, the operating efficiency of the ESP system will be less than the expected efficiency. This will cause the operating costs of the system to be higher than expected, and it is likely that the system's lifespan will be reduced as well.

In this situation, the primary difficulty in addressing the mismatch of the motor and pump is that, unlike the typical rerating scenario described above, the actual shaft load on the motor is unknown. The only thing known about the ESP's operation is that the installed ESP system is not operating as expected. Consequently, rerating the motor in the conventional manner is not possible, and conventionally available tools are of no help. Additionally, it is unlikely that referring to the original well data will be helpful, as it is probable that errors in the well data led to the mismatch problem in the first place. The present systems and methods provide a solution to this problem using only data that is available to the field serviceman at the well site.

Embodiments of the present invention require as input only the nameplate value of the motor in the well and the observed current actually consumed by the motor. The embodiments of the invention will, of course, be most effective when the motor is correctly nameplated (i.e., the nameplate values accurately represent the behavior of the motor) and the motor is supplied the nameplate voltage as the observed current is recorded. Given that, the present systems and methods are able to 1) determine the actual shaft load on the motor and, from that, 2) determine the proper voltage to apply to the motor as well as the expected resultant current that should be drawn by the now correctly-rated motor. In other words, these systems are capable of rerating a motor given nothing more than actual operating current, which has not previously been possible. Used in a slightly different way, the systems can also be used to rerate motors during the ESP system design and motor selection process (before any equipment has been installed).

Before describing specific exemplary embodiments of the invention, it may be helpful to describe an ESP as it is installed in a well. Referring to FIG. 1, a diagram illustrating a typical pump system is shown. A wellbore 130 is drilled into an oil-bearing geological structure 140, and is cased.

The casing within wellbore 130 is perforated at the lower end of the well to allow oil to flow from the formation into the well. Electric submersible pump 120 is coupled to the end of tubing string 150, and the pump and tubing string are lowered into the wellbore to position the pump in producing portion of the well (i.e., the perforated portion). A variable speed drive 110 which is positioned at the surface is coupled to pump 120 by drive output line 112, which runs down the wellbore along tubing string 150, which may be thousands of feet long.

Pump 120 includes an electric motor section 121 and a pump section 122. (Pump 120 may include various other components which will not be described in detail here because they are well known in the art and are not important to a discussion of the invention.) Motor section 121 is operated to drive pump section 122, which actually pumps the oil through the tubing string and out of the well. In this embodiment, motor section 121 uses an induction motor which is driven by variable speed drive 110. Variable speed drive 110 receives AC (alternating current) input power from an external source such as a generator (not shown in the figure) via input line 111. Drive 110 rectifies the AC input power and then produces output power that is suitable to drive motor section 121 of pump 120. This output power is provided to motor section 121 via drive output line 112.

Variable speed drive 110 generates a three-phase output signal that is used to drive motor section 121 of pump 120. The phasing of the output signal is intended to drive pump 120 in a forward direction. The phasing of the output signal can be reversed to drive the pump in the opposite direction as well, and is configured to operate the pump to automatically start the pump in the forward direction, as will be discussed in more detail below. The frequency of the drive output signal can be varied to adjust the speed of the pump motor. When the variable speed drive 110 is properly connected to motor section 121, variable speed drive 110 causes pump 120 to pump oil from the producing portion of the well, through tubing string 150 to well head 151. The oil then flows out through production flow line 152 and into storage tanks (not shown in the figure.)

Figure 2:
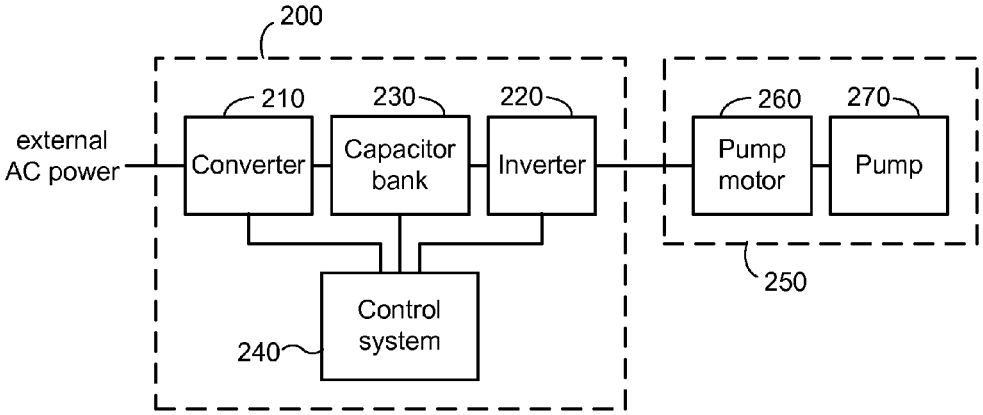
FIG. 2 is a functional block diagram illustrating the general structure of a system including a variable speed drive and pump in accordance with one embodiment.

Referring to FIG. 2, a functional block diagram illustrating the general structure of a system including a variable speed drive and pump in accordance with one embodiment is shown. Variable speed drive 200 includes a converter section 210 and an inverter section 220. The purpose of converter section 210 is to rectify the AC voltage received from the external power source. The DC voltage generated by converter section 210 charges a capacitor bank 230 to a desired voltage. The desired voltage is achieved by controlling the operation of converter section 210. The voltage on capacitor bank 230 is then used to drive inverter section 220. The purpose of inverter section 220 is to generate a three-phase output voltage to drive an electric submersible pump system 250. The output signal may have various output waveforms which may be filtered before being provided to the pump motor 260. The output waveforms then drive motor 260.

Converter section 210 and inverter section 220 operate according to control signals received from a controller such as control module 240 of the variable speed drive. For example, the control module determines the timing with which the SCRs (silicon controlled rectifiers) of the converter section are turned on or "fired." This timing determines when, and for how long the external voltage on the input line is applied to capacitor bank 230, and thereby controls the voltage of the capacitor bank. The control section may also select the desired output mode (e.g., standard PWM mode, six-step mode, or hybrid mode) and adjust the voltage of the output waveform. Control module 240 may therefore control the output voltage to ensure that the voltage is optimized for the actual shaft load of the motor, thereby optimizing the efficiency of the motor. The methodology for determining the actual shaft load and corresponding optimal voltage is discussed in more detail below.

Figure 3:
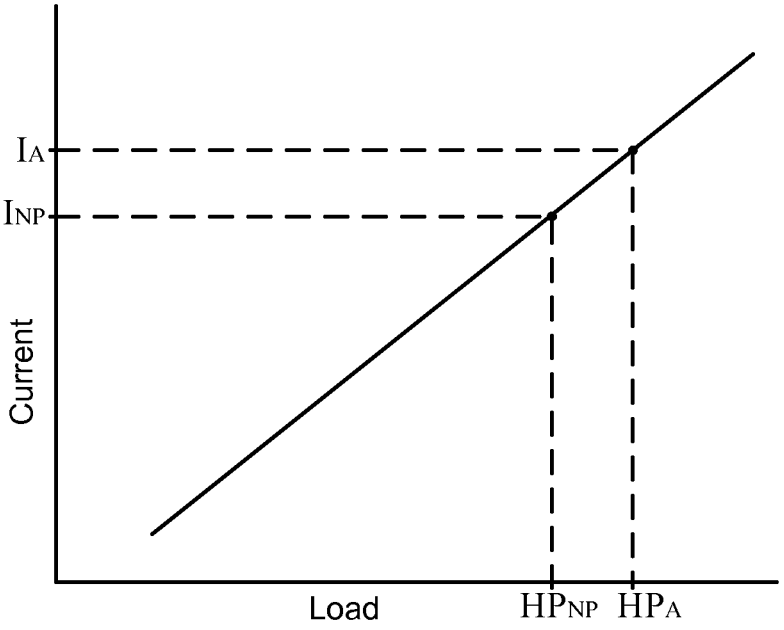
FIG. 3 is a diagram illustrating the relationship between motor current and shaft load horsepower at a constant voltage and frequency in a three-phase induction motor.

The present systems and methods capitalize on some basic behaviors of induction motors. The first of these behaviors is illustrated in FIG. 3. This figure depicts a graph showing the relationship between motor current and shaft load horsepower at a constant voltage and frequency in a three-phase induction motor. For a fixed motor voltage and frequency, the current drawn by the motor is very nearly linear with the shaft load (horsepower). Therefore, if a motor has a nameplate horsepower $HP_{NP}$ and nameplate current $I_{NP}$, but when operated in the well the motor actually draws current $I_A$, then, based on the linear relationship between the current and horsepower, it can be determined that the motor is actually loaded to horsepower $HP_A$. The relationship is:

$$HP_{actual}=[(I_{actual}/I_{nameplate})-0.2]*1.25*HP_{nameplate} \quad (1)$$

Figure 4:
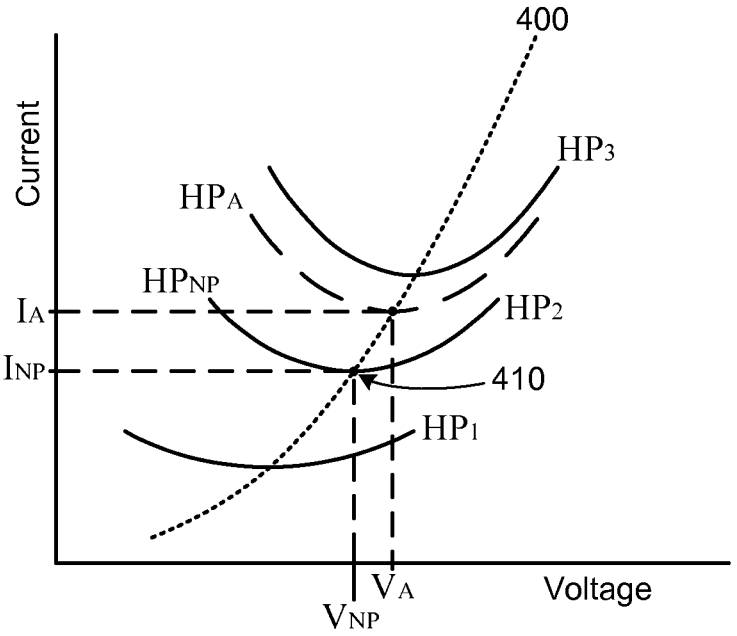
FIG. 4 is a diagram depicting a set of load saturation curves that show the relationship between the current and voltage of an induction motor when the motor is loaded to different horsepowers.

Once the actual shaft load of the motor has been determined, it is necessary to determine the optimal voltage at which the motor will operate most efficiently. For induction motors, each shaft load has a different optimum voltage. FIG. 4 depicts a set of load saturation curves that show the relationship between the current and voltage of an induction motor when the motor is loaded to different horsepowers. Each of the series of "U"-shaped curves shown in FIG. 4 is a constant-horsepower curve—at any point on a given one of the curves, the motor is loaded to a constant horsepower.

The higher and "curvier" curves are higher horsepowers (i.e., $HP_3>HP_2>HP_1, \ldots$). It can be seen from the figure that each horsepower load has one voltage at which the current consumption is minimized. It can also be seen that, for each of the constant-horsepower curves, the voltage at which the current is minimized is different. These minima follow the dotted line 400. The voltage that produces the minimum current draw is the optimum voltage at which to run the motor. The present systems and methods therefore entail finding this minimum-current voltage for the curve that corresponds to the actual horsepower load of the motor.

After a motor is manufactured, it is assigned a "catalog" nameplate. The catalog nameplate typically includes values for horsepower, voltage, current, and power frequency. These values are referred to as the nameplate values (e.g., nameplate horsepower) of the motor. What is being communicated by the nameplate values is that, at the specified power frequency, if the motor shaft is loaded to the specified horsepower, then the specified voltage is the optimum voltage for the motor, and the motor will consume the specified current at that voltage. This does not mean that the motor cannot generate a different horsepower load, or consume a different current at a different voltage—simply that, at the designated frequency, the designated horsepower is most efficiently generated at the designated voltage and will draw the designated current.

When the ESP has been installed in a well, the horsepower load on the motor is determined by the pump and the conditions in the well. This horsepower load may be different from the nameplate horsepower of the motor. If the horsepower load on the motor is different from the nameplate horsepower, the optimum voltage will also be different from the nameplate voltage. The change in the voltage is not one-to-one, but is instead given by the relationship:

$$V_{new}=V_{nameplate}*(HP_{actual}/HP_{nameplate})^{0.25} \quad (2)$$

Thus, the optimum voltage for the motor can be determined from the actual horsepower load, which can itself be determined from the actual current drawn by the motor at the nameplate voltage and frequency.

From equation (2) above, it can be seen that for varying horsepower loads, the optimum voltages change more gradually than the horsepowers. Due to the relative flatness of the current curves in the vicinity of the optimum voltages (see FIG. 4), the currents change even more slowly than the voltages. Consequently, if the actual horsepower is not excessively different from the nameplate horsepower (<~25%), then it can reasonably be expected that the actual current (the non-optimized current) that is initially observed will not change much when the voltage is optimized. Thus, in these cases, the optimized current will be almost the same as the measured current prior to the optimization of the voltage:

$$I_{new}=I_{actual} \quad (3)$$

In cases where the actual horsepower is quite different (>~25%) from the nameplate horsepower, the "$I_{new}=I_{actual}$" current assumption (equation (3) above) does not hold. In this case, it may be desirable to perform an additional iteration of the process (determining the difference between actual and expected current, then determining the actual horsepower load, then determining the optimum voltage). In this second iteration, the previously determined values for current, horsepower and voltage would be used in place of the nameplate values. This second iteration will converge the currents to the point that the current relationship of equation (3) is valid. The second iteration, however, should very rarely be necessary.

Figure 5:
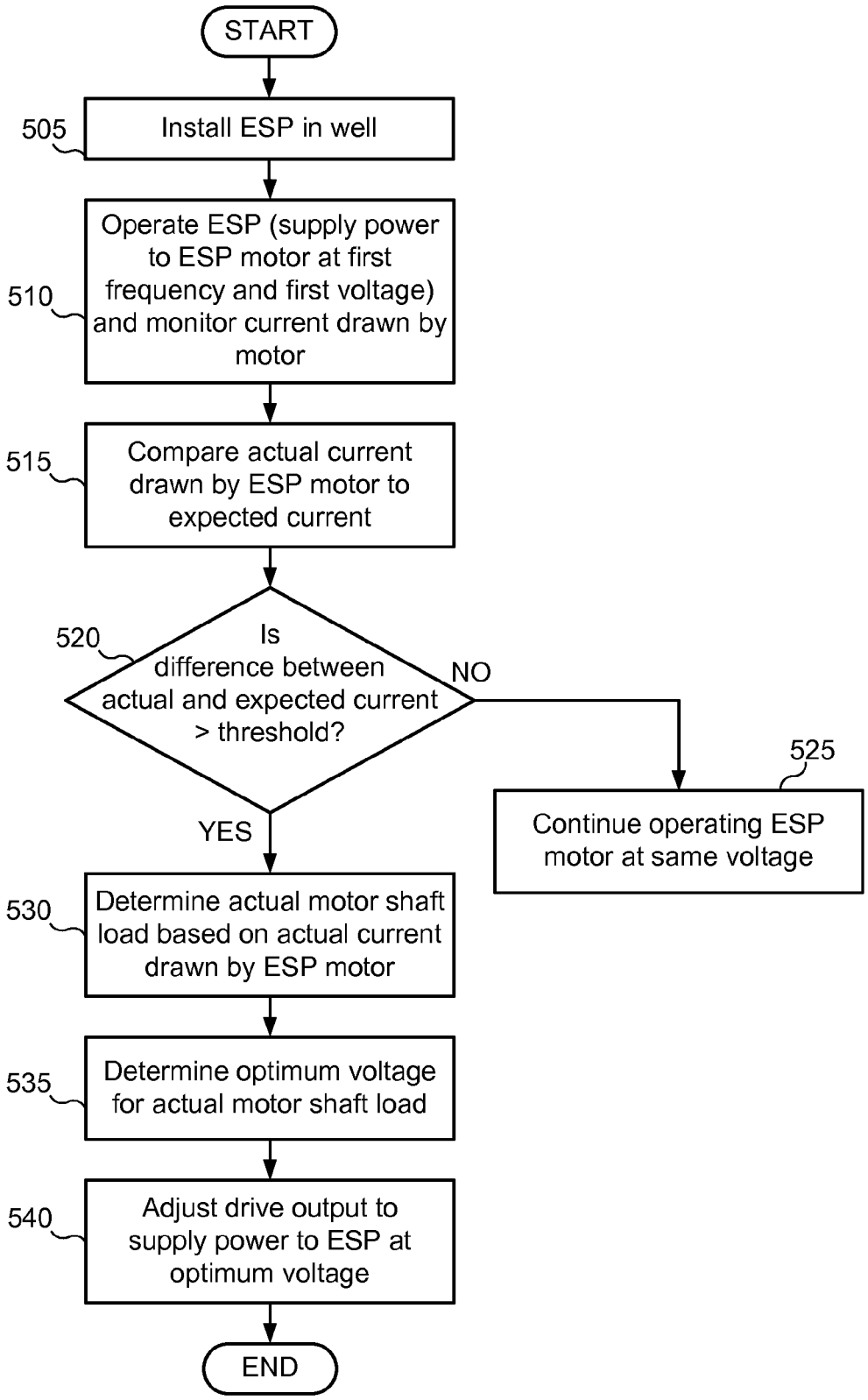
FIG. 5 is a flow diagram illustrating an exemplary method for optimizing the operation of an ESP that is installed in a well in accordance with one embodiment.

Referring to FIG. 5, a flow diagram summarizing an exemplary method for optimizing the operation of an ESP that is installed in a well is shown. In this method, the ESP is first installed in the well (505). The installed ESP is operated at, for example, the nameplate frequency and voltage, and the current drawn by the ESP motor is monitored (510). The actual current (e.g., $I_A$ in FIG. 3) is compared to the expected nameplate current (e.g., $I_{NP}$ in FIG. 3) (515), and it is determined (520) whether the actual current drawn by the motor differs from the nameplate current by more than a threshold percentage (e.g., 25%). If the actual current differs from the nameplate current by less than the threshold percentage, the motor is operating at close to its optimum efficiency, and no change is made to the operating voltage (525). If, on the other hand, the monitored current differs from the nameplate current by more than the threshold percentage, the motor is not operating as efficiently as it should, so a new operating voltage will be determined.

The determination of the new operating voltage begins with determining the actual horsepower load on the motor based on the monitored current (530). The actual horsepower load is determined from the nameplate and actual currents and the nameplate horsepower as shown in equation (1). This is shown graphically in FIG. 3, in which the linear curve represented by equation (1) is intersected at $I_A$ and $HP_A$ (the actual horsepower load). After the actual horsepower load is determined, the optimum voltage corresponding to the actual horsepower load is determined (535). The optimum voltage is computed based on the nameplate and actual horsepower loads and the nameplate voltage as shown in equation (2). This is represented graphically in FIG. 4, in which the optimum voltage ($V_A$) for the actual horsepower load ($HP_A$) is the minimum voltage on the curve corresponding to the actual horsepower load. As an alternative to computing the optimum voltage, the system may be configured to store information corresponding to the load saturation curves in a memory (e.g., in a lookup table) and then retrieving the information as needed.

After the optimum voltage for the actual horsepower load is determined, the drive system for the ESP motor is adjusted to produce an output waveform at the newly determined optimum voltage and the ESP is operated at this voltage (540). As the ESP is operated at the newly determined optimum voltage, the current drawn by the motor at the new voltage is monitored. This current is compared to the current previously drawn by the motor and, if the difference is below a threshold level, no further changes to the voltage are necessary. If the difference is above the threshold level, the process of steps 530-540 can be repeated with the first operating current, voltage and horsepower values used in place of the nameplate values.

It should be noted in regard to the use of the load saturation curves in FIG. 4 that although the curves for different horsepower loads are shifted with respect to each other, the shapes of the curves are the same (but at different scales). This allows the set of curves to be normalized and applied to many different three-phase induction motors. Thus, for example, the curves can be normalized so that curve $HP_2$ represents a normalized horsepower load of 1 hp, and the minimum current of the curve is 1 amp at a voltage of 1 V (at point 410). Then a motor having a nameplate rating of 100 hp, 1500 volts and 40 amps can be represented by scaling the normalized curve to these values. In other words, point 410 is redefined to be at 1500 volts and 40 amps, and curve $HP_2$ is redefined to be 100 hp. Because the load saturation curves can be normalized and then applied in this manner, it is not necessary to maintain separate curves for each motor with which the system may be used—a single set of curves is sufficient to determine the optimum voltage for any of these motors.

The present methods can be implemented automatically or manually. In one embodiment, a controller that is coupled to the electric drive system for the ESP may be configured to perform a method such as the one shown in FIG. 5. The controller may perform the method after the ESP has been installed, or it may periodically perform the method to ensure that the ESP motor is operating at the optimum voltage. The controller may include or may be coupled to one or more sensors, processors, memories, I/O interfaces or other components that enable the controller to receive data (e.g., motor current or nameplate values), perform necessary computations, adjust the voltage of the power supplied to the motor, or perform any other actions associated with the method.

In other embodiments, one or more of the steps of the method may be performed manually. For instance, a well operator or other technician may monitor the current drawn by the motor and may determine based on this current whether it is necessary to adjust the voltage of the output waveform supplied by the electric drive system to the ESP. The well operator may then adjust the operation of the drive as needed to provide the optimum output voltage to the ESP. In another alternative embodiment, the method may be implemented in a combination of automated and manually performed steps.

In another alternate embodiment, the drive unit may be configured to implement more than one of the methodologies described above. For instance, the drive unit could be configured to first attempt one of the methods described above that involves pumping fluid into the tubing string and then allowing the column of fluid to fall through the pump, causing the pump to backspin. If no backspin is detected, this indicates that a check valve is present and is preventing the column of fluid from falling through the pump and causing the motor to backspin. In this case, the drive unit could perform one of the methods described above in which the pump is operated in both forward and reverse directions, and the corresponding torques, flow rates, or other characteristics are compared to determine which direction of rotation is the forward direction.

Those of skill will appreciate that the various illustrative logical blocks, modules, circuits, and algorithm steps described in connection with the embodiments disclosed herein may be implemented as electronic hardware, computer software (including firmware) or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Those of skill in the art may implement the described functionality in varying ways for each particular application, but such implementation decisions should not be interpreted as causing a departure from the scope of the present invention.

The control module described above may be implemented with application specific integrated circuits (ASICs), field programmable gate arrays (FPGAs), general purpose processors, digital signal processors (DSPs) or other logic devices, discrete gates or transistor logic, discrete hardware components, or any combination thereof designed to perform the functions described herein. A controller may include a general purpose processor, CPU, controller, microcontroller, state machine or the like. A controller may also be implemented as a combination of computing devices, e.g., a combination of a DSP and a microprocessor, a plurality of microprocessors, one or more microprocessors in conjunction with a DSP core, or any other such configuration.

The steps of the methods described in connection with the embodiments disclosed herein may be embodied directly in hardware, in software (program instructions) executed by a processor, or in a combination of the two. Software may reside in RAM memory, flash memory, ROM memory, EPROM memory, EEPROM memory, registers, hard disk, a removable disk, a CD-ROM, or any other form of storage medium known in the art. Such a storage medium containing program instructions that embody one of the present methods is itself an alternative embodiment of the invention. One exemplary storage medium may be coupled to a processor, such that the processor can read information from, and write information to, the storage medium. In the alternative, the storage medium may be integral to the processor. The processor and the storage medium may reside, for example, in an ASIC.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein and recited within the following claims.

What is claimed is:

1. A method for adjusting the operation of an electric submersible pump (ESP) motor installed in a well, the method comprising: operating the motor, which is installed in the well, at a first frequency and a first voltage, wherein the first voltage is an optimum voltage for an expected shaft load of the motor; determining a first current that is drawn by the motor at the first voltage; comparing the first current to an expected current and determining a difference between the first current and the expected current; determining an actual shaft load based on the first current, the expected current and the expected shaft load; determining a second voltage based on the actual shaft load, wherein the second voltage is an optimum voltage for the actual shaft load of the motor; and operating the motor at the first frequency and the second voltage.

2. The method of claim 1, wherein determining the actual shaft load based on the first current comprises determining a ratio of the first current to the expected current and multiplying the expected shaft load by the ratio to produce the actual shaft load.

3. The method of claim 1, wherein determining the second voltage comprises determining a ratio of the actual shaft load to the expected shaft load, taking the fourth root of the ratio and multiplying the result by the first voltage to produce the second voltage.

4. The method of claim 1, wherein determining the second voltage comprises identifying a load saturation curve associated with the expected shaft load, identifying a load saturation curve associated with the actual shaft load, and identifying the second voltage as the minimum-current point on the load saturation curve associated with the actual shaft load.

5. The method of claim 4, wherein identifying the load saturation curve associated with the expected shaft load comprises identifying a normalized load saturation curve and scaling the normalized load saturation curve to the expected shaft load.

6. The method of claim 1, further comprising installing the ESP in the well prior to operating the motor at the first frequency.

7. The method of claim 1, wherein operating the motor at the first voltage comprises controlling an electric drive at the surface of the well to produce an output waveform at the first voltage and supplying the output waveform at the first voltage to the motor; and wherein operating the motor at the second voltage comprises controlling the electric drive to produce the output waveform at the second voltage and supplying the output waveform at the second voltage to the motor.

8. The method of claim 1, further comprising, prior to determining the actual shaft load, determining whether the difference between the first current and the expected current exceeds a predetermined threshold; wherein determining the actual shaft load is performed only when the difference between the first current and the expected current is determined to meet the predetermined threshold.

9. The method of claim 1, further comprising:

determining a second current that is drawn by the motor at the second voltage;

comparing the second current to the first current and determining a difference between the first current and the second current;

redetermining the actual shaft load based on the first current, the second current and the first-determined actual shaft load;

determining a third voltage based on the redetermined actual shaft load, wherein the third voltage is an optimum voltage for the redetermined actual shaft load of the motor; and operating the motor at the first frequency and the third voltage.

10. The method of claim 1, wherein the first voltage comprises a nameplate voltage for the motor, wherein the expected current comprises a nameplate current for the motor, and wherein the expected shaft load comprises a nameplate shaft load for the motor.

11. A system for adjusting the operation of an electric submersible pump (ESP) motor installed in a well, the system comprising: an electric drive that generates an output waveform which drives an ESP motor that has been installed in the well; and a controller coupled to the electric drive, wherein the controller controls a voltage of the output waveform; wherein the controller first controls the electric drive to produce the output waveform at a first frequency and a first voltage, wherein the first voltage is an optimum voltage for an expected shaft load of the motor, determines a first current that is drawn by the motor at the first voltage, compares the first current to an expected current and determines a difference between the first current and the expected current, determines an actual shaft load based on the first current, the expected current and the expected shaft load, determines a second voltage based on the actual shaft load, wherein the second voltage is an optimum voltage for the actual shaft load of the motor, and controls the electric drive to adjust the output waveform from the first voltage to the second voltage.

12. A system for adjusting the operation of an electric submersible pump (ESP) motor installed in a well, the system comprising:

an electric drive that generates an output waveform which drives an ESP motor; and a controller coupled to the electric drive, wherein the controller controls a voltage of the output waveform;

wherein the controller first controls the electric drive to produce the output waveform at a first frequency and a first voltage, wherein the first voltage is an optimum voltage for an expected shaft load of the motor, determines a first current that is drawn by the motor at the first voltage, compares the first current to an expected current and determines a difference between the first current and the expected current, determines an actual shaft load by determining a ratio of the first current to the expected current and multiplying the expected shaft load by the ratio to produce the actual shaft load, determines a second voltage based on the actual shaft load, wherein the second voltage is an optimum voltage for the actual shaft load of the motor, and controls the electric drive to adjust the output waveform from the first voltage to the second voltage.

13. The system of claim 12, wherein the controller determines the second voltage by determining a ratio of the actual shaft load to the expected shaft load, taking the fourth root of the ratio and multiplying the result by the first voltage to produce the second voltage.

14. The system of claim 12, wherein the controller determines the second voltage by identifying a load saturation curve associated with the expected shaft load, identifying a load saturation curve associated with the actual shaft load, and identifying the second voltage as the minimum-current point on the load saturation curve associated with the actual shaft load.

15. The system of claim 14, wherein the controller identifies the load saturation curve associated with the expected shaft load by identifying a normalized load saturation curve and scaling the normalized load saturation curve to the expected shaft load.

16. The system of claim 12, wherein the controller determines, prior to determining the actual shaft load, whether the difference between the first current and the expected current exceeds a predetermined threshold; wherein the controller determines the actual shaft load only when the difference between the first current and the expected current meets the predetermined threshold.

17. The system of claim 12, further comprising an ESP that contains the ESP motor, wherein the ESP motor is an induction motor, and wherein the ESP is installed in a well.

18. The system of claim 12, further comprising one or more sensors that measure currents drawn by the ESP motor.

* * * * *